US006969179B2

(12) United States Patent
Sloan et al.

(10) Patent No.: US 6,969,179 B2
(45) **Date of Patent: *Nov. 29, 2005**

(54) PERIMETER LIGHTING APPARATUS

(75) Inventors: Thomas C. Sloan, Santa Barbara, CA (US); James J. Sloan, Santa Barbara, CA (US)

(73) Assignee: Sloanled, Inc., Ventura, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/770,956

(22) Filed: Feb. 2, 2004

(65) Prior Publication Data

US 2004/0156197 A1 Aug. 12, 2004

Related U.S. Application Data

(62) Division of application No. 10/202,276, filed on Jul. 24, 2002.

(60) Provisional application No. 60/307,820, filed on Jul. 25, 2001.

(51) Int. Cl.[7] ..... F21S 4/00

(52) U.S. Cl. ..... 362/219; 362/240; 362/249; 362/800; 362/145; 362/216; 362/222; 362/223; 362/368; 362/806; 362/190

(58) Field of Search ..... 362/240, 249, 362/396, 267, 800, 145, 147, 152, 216, 219, 362/217, 222, 223, 368, 806, 98, 99, 190

(56) References Cited

U.S. PATENT DOCUMENTS

| | | | | |
|---|---|---|---|---|
| 4,439,818 | A | 3/1984 | Scheib | 362/250 |
| 4,521,839 | A | 6/1985 | Cook et al. | 362/238 |
| 4,712,165 | A | 12/1987 | Cetrone | 362/147 |
| 5,099,401 | A | 3/1992 | Kondo et al. | 362/541 |
| 5,559,681 | A | 9/1996 | Duarte | 362/252 |

(Continued)

FOREIGN PATENT DOCUMENTS

| | | | |
|---|---|---|---|
| EP | 0606006 | A | 7/1994 |
| WO | WO 9906759 | A | 2/1999 |
| WO | WO 0107828 | A | 2/2001 |

OTHER PUBLICATIONS

Patent Abstracts of Japan, vol. 2002, No. 10, Oct. 10, 2002, Moriyama Sangyo KK, Publication No. 2002163907, Publication Date, Nov. 24, 2000 "Light System and Lighting Unit".

*Primary Examiner*—Sandra O'Shea
*Assistant Examiner*—Sharon Payne
(74) *Attorney, Agent, or Firm*—Koppel, Jacobs, Patrick & Heybl

(57) ABSTRACT

An elongated perimeter light is disclosed, which comprises a linear array of light sources (LEDs) that are electrically illuminated. The array of light sources is disposed within an elongated transparent tube, with the tube transmitting and dispersing the light from the array giving the appearance that said array of light sources is a continuous light source. The array of light sources is capable of being cut at intervals down its length to shorten it. The light sources that remain in the array continue to emit light and the tube can be cut to match the length of said array. The present invention also discloses systems for lighting structural features, with one system according to the present invention comprising a plurality of elongated perimeter lights. The perimeter lights are electrically coupled in a daisy chain with the electrical power at each of the perimeter lights being transmitted to the successive light. A mechanism is included for anchoring the plurality of perimeter lights to a structure to illuminate it. Each of the perimeter lights can be cut at intervals down its length while not interfering with its ability to transmit its electrical power to successive lights.

7 Claims, 8 Drawing Sheets

U.S. PATENT DOCUMENTS

| | | | | |
|---|---|---|---|---|
| 6,186,645 | B1 | 2/2001 | Camarota | 362/249 |
| 6,283,612 | B1 | 9/2001 | Hunter | 362/240 |
| 6,406,166 | B1 | 6/2002 | Ko | 362/249 |
| 6,511,206 | B1 | 1/2003 | Fan Wong et al. | 362/250 |
| 6,609,813 | B1 | 8/2003 | Showers et al. | 362/240 |
| 6,776,504 | B2 * | 8/2004 | Sloan et al. | 362/240 |
| 6,796,680 | B1 * | 9/2004 | Showers et al. | 362/246 |
| 2003/0012627 | A1 * | 1/2003 | Lee et al. | 414/217.1 |
| 2003/0048641 | A1 | 3/2003 | Alexanderson et al. | 362/470 |
| 2003/0210546 | A1 * | 11/2003 | Chin | 362/249 |

* cited by examiner

PERIMETER LIGHTING APPARATUS

This application is a divisional of patent application Ser. No. 10/202,276 filed on Jul. 24, 2002, and claims priority of that application.

This application claims the benefit of provisional application Ser. No. 60/307,820 to Sloan et al., which was filed on Jul. 25, 2001.

BACKGROUND OF THE INVENTION

1. Field of the Invention

This invention relates to perimeter or border lighting for buildings and more particularly to perimeter or border lighting using light emitting diodes as the light source.

2. Description of the Related Art

Perimeter or border lights ("perimeter lighting") are commonly used on buildings to accentuate the structure, to draw customer attention to the building, and to provide safety lighting. Most conventional perimeter lights use neon bulbs for the light source. Some of the disadvantages of neon lighting is that neon bulbs have a relatively short life, are fragile and can consume a relatively large amount of power. Also, neon bulbs can experience difficulty with cold starting, which can lead to the bulb's failure.

Developments in Light emitting diodes ("LEDs") have resulted in devices that are brighter, more efficient and more reliable. LEDs are now being used in many different applications that were previously the realm of incandescent bulbs; some of these include displays, automobile taillights and traffic signals. As the efficiency of LEDs improve it is expected that they will be used in most lighting applications.

U.S. Pat. No. 4,439,818 to Scheib discloses a lighting strip that utilizes LEDs as the light source. The strip is flexible in three dimensions and is useful in forming characters and is capable of providing uniform illumination regardless of the characters selected for display. The strip comprises a flexible multi-layered pressure sensitive adhesive tape, having a plurality of triangle cutout sections on each side of the tape, with LEDs connected in a series with a resister. One disadvantage of this strip is that it cannot be cut to different lengths for different applications. Instead, different lengths of the strip must be used. Further, the light from the LEDs is not diffused to give the appearance of neon light. This arrangement is not durable enough to withstand the conditions for outdoor use. The flexible tape and its adhesive can easily deteriorate when continually exposed to the elements.

U.S. Pat. No. 5,559,681 to Duarte, discloses a flexible, self adhesive, light emissive material, that can be cut into at least two pieces. The light emissive material includes a plurality of light electrically coupled light emissive devices such as light emitting diodes. The material also includes electric conductors for conducting electric power from the source of electric power to each of the light emissive devices. While this lighting arrangement is cuttable to different lengths, the light it emits is not dispersed so that it resembles neon light. This arrangement is also not durable enough to withstand the conditions for outdoor use.

LEDs have been used in perimeter lighting applications. PCT International Application Number PCT/AU98/00602 discloses perimeter light that uses LEDs as its light source and includes a light tube structure in which multiple LEDs are arranged within an elongated translucent tube that diffuses or disperses the light from the LEDs. The perimeter light is used to highlight or decorate one or more features of a structure, such as a roof edge, window, door or corner between a wall or roof section.

One of the disadvantages of this light is that it cannot be cut to match the length of a building's structural features. Instead, the perimeter lighting must be custom ordered or it is mounted without fully covering the structural feature. Also, the connectors between adjacent sections of lighting are bulky and result in a visible junction between the sections. In addition, the light's tube significantly attenuates the light emitted by its LEDs, significantly reducing the light's brightness. Further, the light does not include a mechanism for compensating for the expansion and contraction between adjacent lights.

SUMMARY OF THE INVENTION

The present invention provides an improved elongated perimeter light that uses light emitting diodes (LEDs) as its light source to take advantage of their improved efficiency and longevity. The perimeter light can be connected in series with other perimeter lights, with each of the lights capable of being cut in the field to match the length of the structural feature.

One embodiment of an elongated perimeter light comprises a linear array of light sources (LEDs) that are electrically illuminated. The array of light sources is disposed within an elongated transparent tube, with the tube transmitting and dispersing the light from the array giving the appearance that the array of light sources is a continuous light source. The array of light sources is capable of being cut at intervals down its length to shorten it. The remaining light sources in said array continue to emit light and the tube can be cut to match the length of said array.

The present invention also discloses systems for lighting structural features, with one system according to the present invention comprising a plurality of elongated perimeter lights similar to those described in the previous paragraph. The perimeter lights are electrically coupled in a daisy chain with the electrical power at each of the perimeter lights being transmitted to the successive light. A mechanism is included for anchoring the plurality of perimeter lights to a structure to illuminate it.

The tube of each perimeter light disperses the light from the light source array without over attenuating it, so that perimeter light provides bright light that simulates the look of straight tube neon. By being cuttable at intervals, custom sized lighting devices do not need to be ordered, reducing the lead-time and expense associated with installing perimeter lighting.

The new perimeter light also provides a new mounting device that includes a mounting button and screw. The buttons are mounted to the structural feature along the line for the new perimeter lighting, preferably using the screws. The back of the new perimeter light is designed to fit over the buttons by either sliding the tube along the button or snapping the tube in place on the button.

The new perimeter light also provides bumpers that fit on the open ends of each tube. The bumpers of adjacent perimeter lights rest adjacent to one another so that they can compensate for the expansion and contraction of the tubes during temperature change. They are also designed to glow and illuminate at the color of the perimeter light. Covers can be used over the junction between adjacent lights, with the covers preferably made of the same material as the tube. The combination of illumining bumpers with the cover section allows the junction to emit light similar to the perimeter light.

The new perimeter light is rugged, energy efficient and easy to install. It is 30 to 70% more efficient than neon lighting and the LEDs can last more than 5 times longer than neon bulbs. It can easily be installed as a replacement to conventional neon lighting.

These and other further features and advantages of the invention will be apparent to those skilled in the art from the following detailed description, taken together with the accompanying drawings, in which:

DETAILED DESCRIPTION OF THE INVENTION

Figure 1:
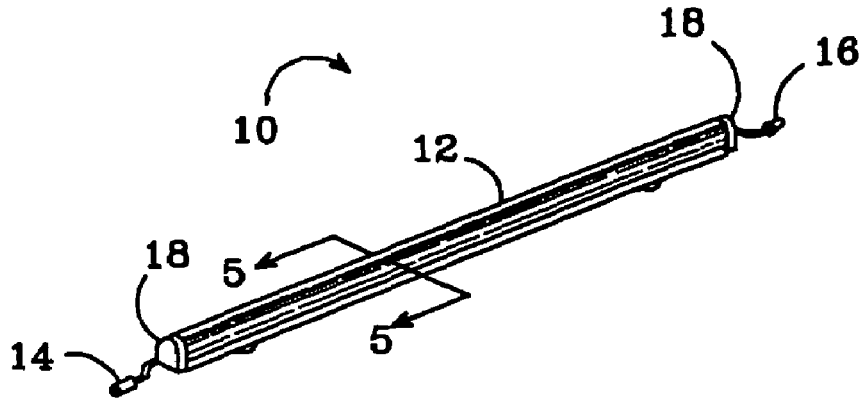
FIG. 1 is a perspective view of one embodiment of the new perimeter light according to the present invention.

FIG. 1 shows one embodiment of a perimeter light 10 constructed in accordance with the present invention. It includes an elongated tube 12 that has a substantially oval shaped cross-section, and houses a PCB with LEDS in a linear array (shown in FIGS. 2*a* and 2*b*). The tube material should be impact resistant and UV stable with one of the preferred materials being acrylic. To provide the maximum light emission from the LEDs, the tube should have filter characteristics that transmit primarily the wavelength of light emitted from the LED array, while having the opacity to diffuse but not over-attenuate the emitting light.

The perimeter light 10 has a male connector 14 at its first end and a female connector 16 at its second end, both arranged so that multiple lights 10 can be electrically connected in series. Other embodiments can have the connector types reversed or can use different connectors. This allows multiple lights 10 to be connected along a long or high structural feature and then illuminated from a single power source (shown in FIG. 3). In one embodiment, the power source is connected to the male connector 14 of the first light 10 to illuminate the light. The power from the power source is conducted to the second light 10 in the series through the connected female 16 to male connectors 16, 14 between the first and second lights. The power is conducted to subsequent lights 10 in the series in the same way.

End bumpers 18 are included to provide a protective seal at the ends of the tube 12 to protect the light's internal components. When one or more perimeter lights 10 are linearly connected, the end bumpers 18 are included to compensate for expansion and contraction of the lights 10 from heat of the LEDs or from the ambient temperature. The bumpers 18 also compensate for the different expansions between the tube 12 and internal LED array PCB. If for instance the LED array PCB expands more than the tube for a given temperature, the array PCB can extent from the end of the tube. The bumper 18 should compensate for this expansion while not being forced from the end of the tube 12.

As more fully described below, different embodiments of bumpers can be used. The preferred bumpers 18 are at least partially transparent to glow and illuminate at the color of the perimeter light or at the color of the light's internal light source. This allows multiple connected perimeter lights 10 to appear as one continuous light.

Figure 2A:
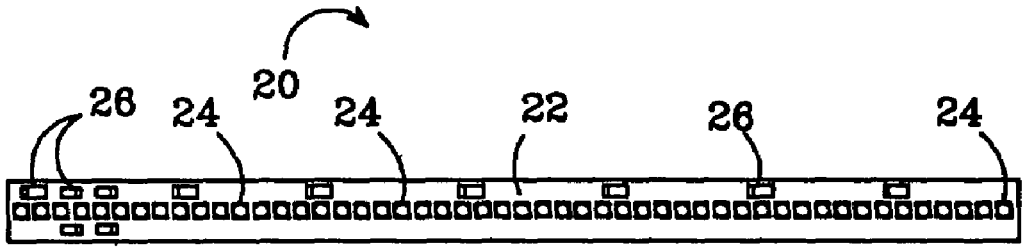
FIG. 2*a* is a plan view of one embodiment of a PCB LED linear array according to the present invention.
Figure 2B:
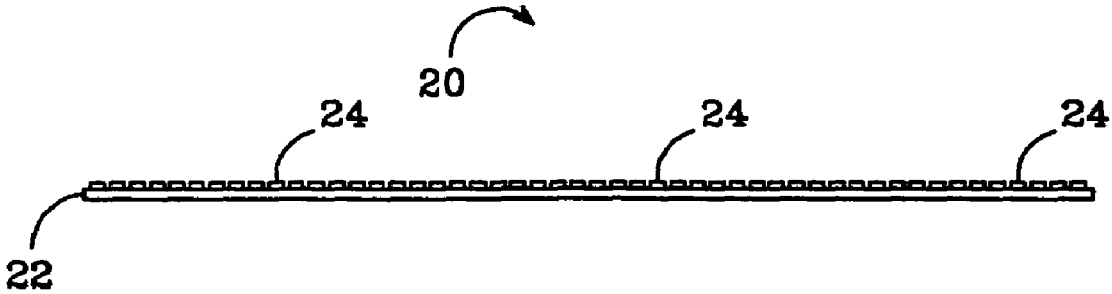
FIG. 2*b* is an elevation view of the PCB LED linear array shown in FIG. 2*b;*

FIGS. 2*a* and 2*b* show the LED array PCB 20 that is arranged inside the tube 12, with the light from the LEDs directed primarily through the top curved section of the tube 12. The LED array 20 comprises a PCB 22 having LEDs 24 that are mounted on the PCB by conventional methods. The LEDs 24 are preferable arranged on one side of the PCB, linearly down the PCB's longitudinal axis, although the LEDs could be arranged in different locations. In one embodiment of the LED array, there are 60 LEDs every 24 inches of PCB. The LED array 20 also has additional electronic devices 26 that can include capacitors, diodes and resistors, as more fully described below.

The preferred LED array 20 uses LEDs 24 at a very close pitch. In one embodiment the LEDs 24 are approximately 0.4 inches apart as measured from the LED centers. The LED array 20 is held within the tube, approximately 1 inch from the top of the curved section of the tube 12 shown in FIG. 1. The tube is formulated to allow the maximum amount of light to be transmitted, while at the same time diffusing the light enough to prevent bright and dark spots when the light emits from the tube 12.

Figure 3:
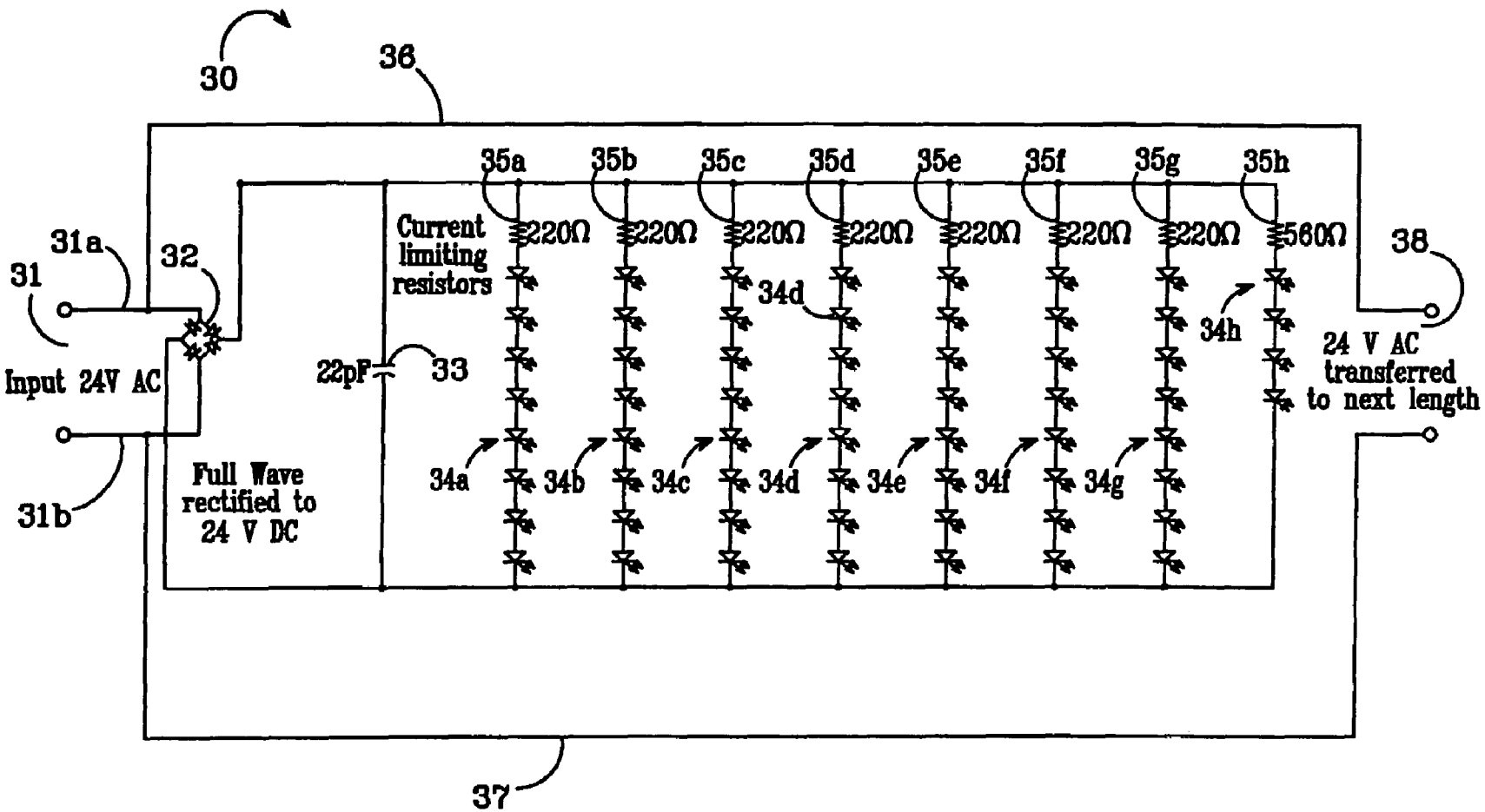
FIG. 3 is a schematic of one embodiment of the electronic elements in a PCB LED linear array according to the present invention.

FIG. 3 is a schematic 30 of the LED array 20 of FIG. 2*a* and 2*b*, showing its electronic components and their interconnections. A power supply 31 provides power to the LED array 30. The array 30 can operate from many different power supplies with a preferred power supply providing 24-volt (V) AC power. In one embodiment a step down transformer (not shown) is used to reduce the typical 120V AC power. The 24V AC power can be connected to LED array 30 along two 20 AWG wires 31*a*, 31*b*. The 24V AC power is then applied to a diode bridge rectifier 32, which full wave rectifies the AC signal. A capacitor 33 is included to smooth the rectified signal to an approximate 24V DC. The DC power is then applied to a sub-array of 8 LEDs 34*a* that are arranged in series with a current limiting resister 35*a*.

The LED array 30 can include additional parallel LED sub-arrays 34*b–h*, with each having the same or a different number of LEDs as array 34*a*. Each of the sub-arrays 34*b–h* is arranged in parallel to the first sub-array 34*a* with the DC power applied across each of the sub-arrays 34*a–h*. The preferred LED array 30 has eight total parallel LED sub-arrays 34*a–h* with the first seven sub-arrays 34*a–g* having 8 LEDs and the last sub-array 34*h* having 4 LEDs. Each of the LED circuits has a respective current limiting resistor 35*a–h*.

The LED array 30 transfers the 24V AC power from the one end to the other along conductors 36 and 37, which are connected to an LED array output 38. This allows a plurality of light emitting devices to be "daisy chained" together by connecting the output connector from the first perimeter light to the input connector on the next perimeter light and so on. A conventional step down transformer (not shown) can provide a 24V AC power supply to power up to 100 feet of daisy chained perimeter lights. Other transformers can power greater lengths of lights and the use of different electronic components can increase or decrease the length of lighting that can be powered.

As mentioned above, one of the advantages of the new perimeter light 10 is that it can be cut to match the length of a particular structural feature. The conductors 37 and 38 pass through the LED array 39, independent of the power applied to the sub-arrays 34*a–h* so that one or more of the sub-arrays can be cut-away without cutting the conductors 37, 38. One of the intermediate lights 10 in a daisy chain can be cut to match a structural feature while still allowing the light to be daisy-chained with additional lights. This provides the ability to mount the new perimeter lights on various structural features without having to special order lengths of lights to match the length of the structural feature.

The new light 10 is shortened by cutting one or more of the parallel LED sub-arrays 34*a–h* away from the LED array 30, and cutting off the corresponding length of tube 12. One embodiment of the LED array PCB 20 (as shown in FIGS. 2*a* and 2*b*) is marked along its length in the locations where it can be cut. The cutting locations correspond to the connections between the parallel LED sub-arrays 34*a–h*. For instance, one of the marks corresponds to the location between LED sub-arrays 34*b* and 34*c* so that cutting at the mark would remove parallel LED sub-arrays 34*c–h*, leaving sub-arrays 34*a* and 34*b*.

Figure 4A:
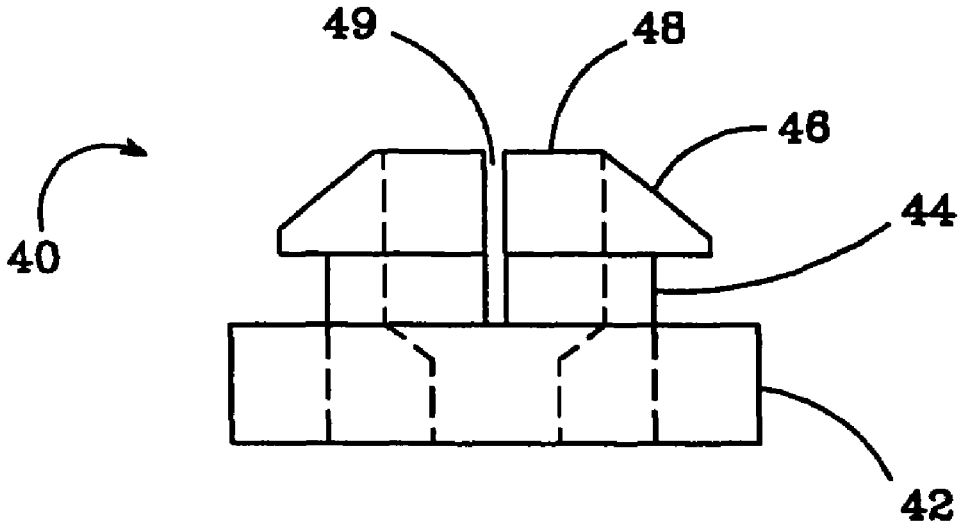
FIG. 4*a* is an elevation view of one embodiment of a mounting button according to the present invention.
Figure 4B:
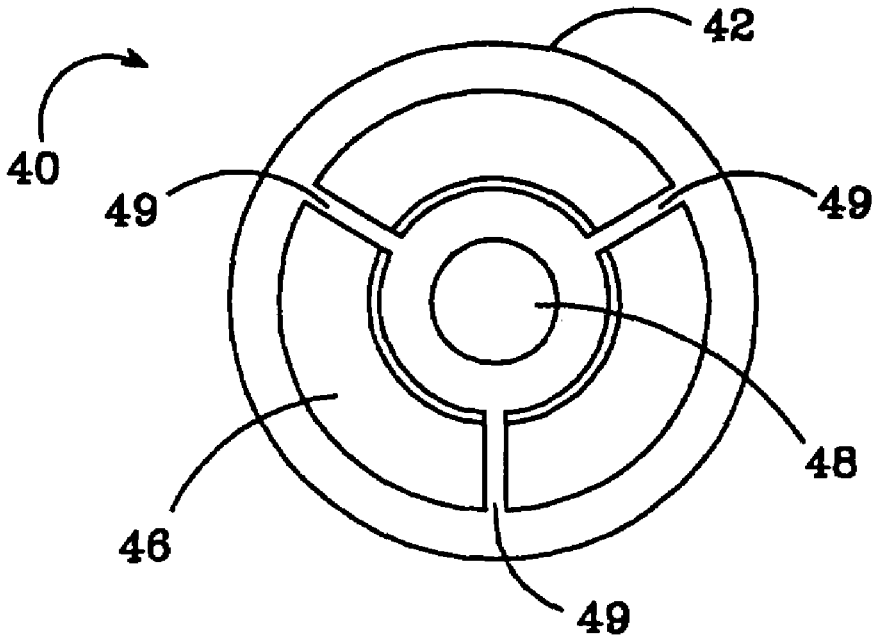
FIG. 4*b* is a plan view of the embodiment of the mounting button in FIG. 4*a;*

FIGS. 4*a* and 4*b* show one embodiment of a mounting button 40 according to the present invention, which is used to mount the new perimeter light 10 to a structural feature. The new button 40 can have many different dimensions with the embodiment shown having a cylindrical base section 42 that is approximately 0.25 inches high and has a radius of approximately 0.8 inches. Above the base section is the lip section 44 that is also cylindrical and is coaxial with the base section, but has a diameter of approximately 0.5 inches. Above the lip section 44 is the tab section 46 that is coaxial with the base and lip sections 42, 44 and has a diameter of approximately 0.6 inches. The tab section 46 tapers away from the lip section 44 toward its top. The entire button has a coaxial cavity 48 for a screw to pass through, with the top part of the cavity 48 having a larger diameter to house a screw head. Three equally spaced vertical cuts 49 are included through the lip and tab sections 42 and 44 so that the three sections can flex toward the button's axis. As described below, this flex works with the features on the back of the tube 12 to mount the perimeter light 10 to the button 40.

Figure 5:
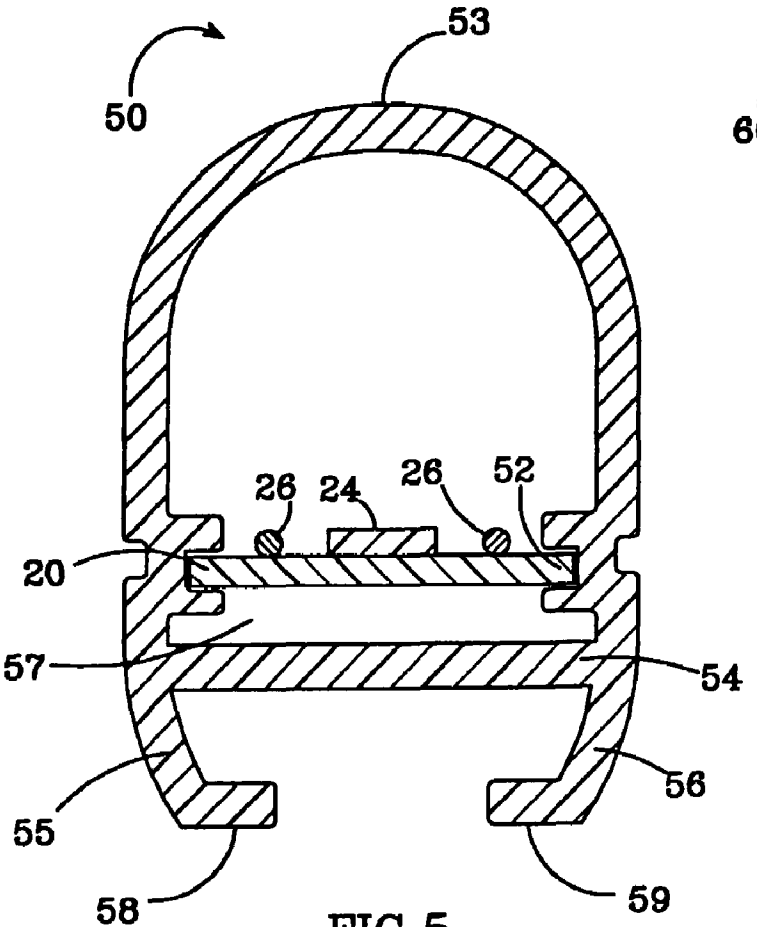
FIG. 5 is a sectional view of the tube shown from the perimeter light shown in FIG. 1, taken along section lines 5—5.

FIG. 5 shows a sectional view of the tube 12 shown in FIG. 1, which has a PCB slot 52 for holding the LED array 20 in a horizontal orientation with the light from the LEDs directed primarily toward the top 53 of the tube 12. A horizontal section 54 provides the lower enclosing surface for the tube 12 to protect the LED array 20. The section 54 is parallel to the LED array 20 and when the array is installed in the slot 52, a space 57 remains between the bottom of the array 20 and the horizontal section 54 that promotes dissipation of heat from the array's LEDs 24 and electronic components 26. This helps the light 10 operate without overheating.

When the LED array PCB 20 is installed, there is approximately one inch between the LEDs 24 and the top 53 of the tube 50. The thickness of the tube 12 can vary with a suitable thickness being approximately 0.85 inches. The tube 12 can be made from many materials with one of the preferred materials being acrylic. The tube can be fabricated to illuminate at various colors and dissipate the emitting light to reduce bright and dark spots.

Below the horizontal section 54, the tube 12 has two opposing tabs 55, 56 are provided that run the longitudinal length of the tube/lens to form a slot under the horizontal section 54. Each tab 55, 56 tapers toward the other and at the bottom of each tab there are opposing horizontal sections 58, 59 with an opening between the edges of the two. The slot formed by the member 54 and opposing tabs 55, 56 houses the new mounting button 40 (shown in FIGS. 4*a* and 4*b*) when mounting the light 10 to a structural feature.

The buttons 40 are mounted along a line of the structural feature where the light(s) 40 are to be mounted. A preferred mounting method is by a screw passing through the bottom cavity 48 and turning into the structural feature. As the screw is tightened, the screw head is housed in the larger diameter section of the button cavity 48. After the mounting the button 40, the light 10 can either slide onto the buttons or snap over them. When the light 10 is slid on, one of the tube's ends is held so that the tube's horizontal tab sections 58, 59 mate with the button's lip section 44. The tube 12 is slid onto the button so that the tab section 46 is disposed within the tube's slot.

When snapping the light 10 in place, it is held over the buttons 40 with the top of the buttons tab section 46 within or adjacent to the opening between the horizontal sections 58 and 59. A force is applied to the light 10 in the direction of the button 40, moving the opposing tabs 58, 59 down the taper on the button's tab section 46. This force causes the opposing tabs 55, 56 to flex out as they slide down the button 40, while the lip and tab sections 42 and 44 compress toward the button's longitudinal axis. This continues until the tab's horizontal sections 58, 59 snap into the button's lip section 44 so that the button's tab section 46 is held within the tube's slot. The tube is held on the button 40 by the overlap between the tabs' horizontal sections 58, 59 and the button's tab section 46.

Figure 6B:
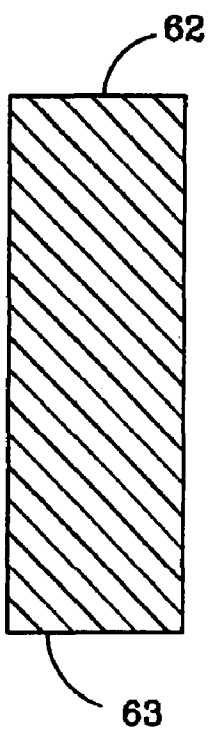
FIG. 6*b* is a sectional view of the end bumper shown in FIG. 6*a*, taken along section lines 6*b*—6*b;*
Figure 6A:
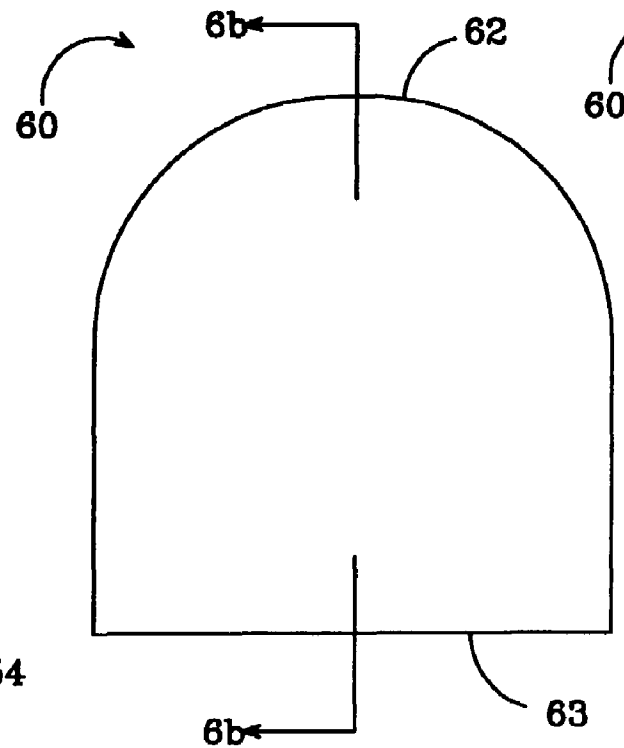
FIG. 6*a* is a front elevation view of a one embodiment of an end bumper according to the present invention.

FIGS. 6*a* and 6*b* show one embodiment of the bumper 60 that can be mounted at the open ends of the tube 12. The bumper 60 has a shape similar to the end of the tube 12 as shown in the FIG. 5. The bumper's top surface 62 has a radius of curvature to match the curvature of the top 53 of the tube 12. The bumper's bottom surface 63 is horizontal and matches the tube's horizontal section 54.

The preferred bumper 60 is made of a flexible and durable material such as silicon, although other materials can also be used. It can be mounted to the end of the tube 12 by many methods, with the preferred method being gluing. The bumper 60 provides an air and water tight enclosure to protect the LED array PCB 20 and wiring within the tube 12. The bumper 60 also compensates for the tube's expansion and contraction due to heating when the tubes are placed end-to-end in a series. As adjacent tubes expand, the bumpers 60 between them can compress, and when they contract the adjacent bumpers 60 can expand. The bumpers 60 can be colored to illuminate at the same color as the tube 12. For a tube that is red to transmit a red color from the LEDs, the bumper 60 can be made of silicon rubber that is translucent red. Alternatively, the bumper 60 can transmit the light of the LEDs 24 without substantially changing the color. The color can then be changed to match the color of the tube, when it passes through a joint cover. When used with the cover described below, the bumpers 60 help give a continuous look to multiple sections of the new perimeter lights.

In another embodiment (not shown), a clear plate can be affixed over the end of the tube 12 before mounting the bumper 60. The clear plate allows light from the LED array to transmit through to the bumper, while providing a larger surface for affixing the bumper 60 to the tube 12.

Figure 7A:
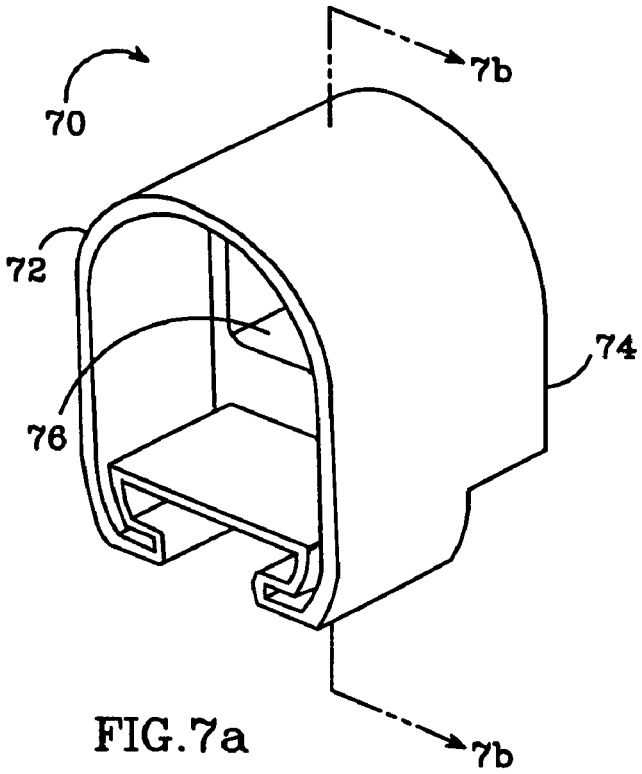
FIG. 7*a* is a perspective view of another embodiment of an end bumper according to the present invention.
Figure 7B:
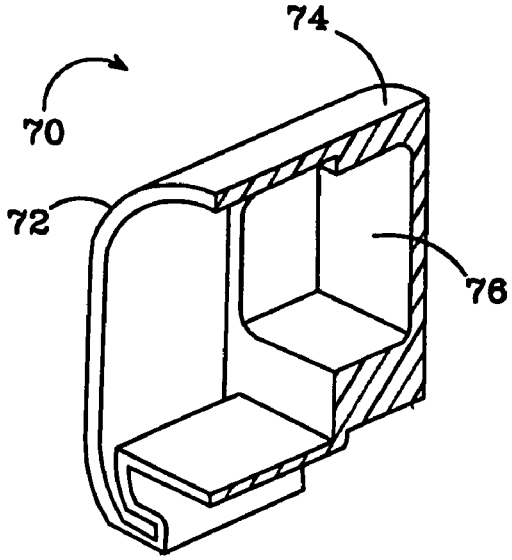
FIG. 7*b* is a perspective sectional view of the end bumper in FIG. 7*a*, taken along section lines 7*b*—7*b*.

FIGS. 7*a* and 7*b* show another embodiment of an end bumper 70 according to the present invention, which can be made of the same flexible and durable material as bumper 60. Bumper 70 has a sleeve 72 in the shape of the cross-section of the tube 12, so that the sleeve 72 can fit over the end of the tube 12. The bumper 70 also includes a cushion section 74 that extends beyond the end of the tube 12 when the bumper 70 is mounted on the tube 12. The cushion section 74 is compressible to compensate for expansion of adjacent lights 10 when heated and can thereafter expand when the lights contract. To allow cushion section 72 to compress more easily, it has an internal void 76. Bumper 70 has an end surface which allows it to provide an air and watertight seal with the end of the tube 12. The bumper 70 can be press fit over the end of the tube 12 or it can be glued in place.

Figure 8A:
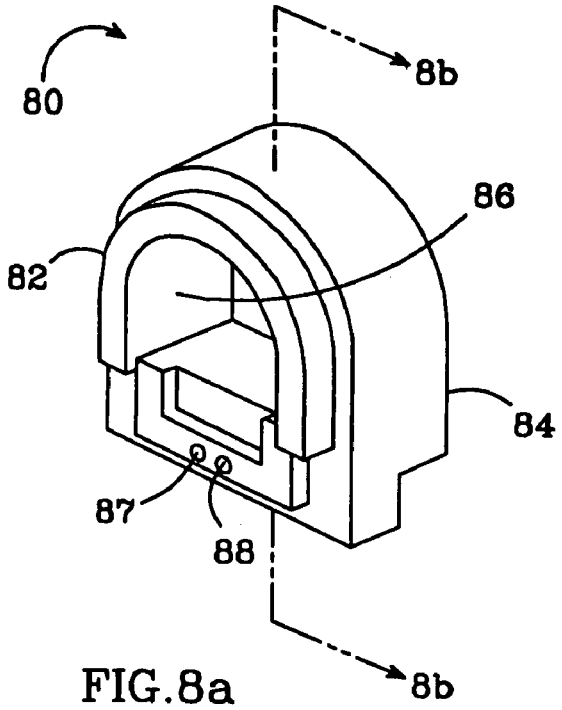
FIG. 8*a* is a perspective view of another embodiment of an end bumper according to the present invention.
Figure 8B:
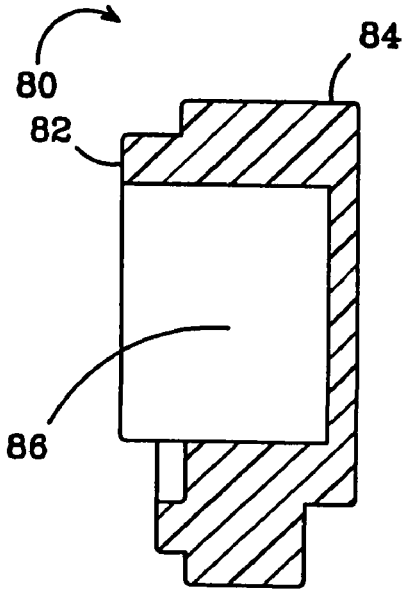
FIG. 8*b* is a sectional view of the end bumper in FIG. 8*a*, taken along section lines 8*b*—8*b;*

FIGS. 8*a* and 8*b* show another embodiment of an end bumper 80 according to the present invention. It also has a shape similar to the tube's cross-section. However, it does not have a sleeve that fits over the end of the tube 12, but instead has a horseshoe shaped section 82 that fits within the tube 12. The curved portion of section 82 has a diameter that allows it to fit on the inside surface of the tubes top portion 53 (shown in FIG. 5) with a close fit. The bumper 70 can be affixed to the end of the tube 12 by different means such as gluing with the horseshoe section within the end of the tube 12.

The bumper 80 has a cushion section 84 that extends beyond the end of the tube 12, with the section 84 having an internal void 86 that allows it to be easily compressible. The bumper 80 also has two through holes 87, 88. When the bumper is mounted at the first and second ends of the perimeter light the holes at the first end allow lines 31*a*, 31*b* (see FIG. 3) to pass to the LED array PCB. The holes at the light's second end allow lines 36, 37 (see FIG. 3) to pass from the LED array PCB. This allows power to pass to and from the light's internal LED array PCB.

Like the bumpers 60, 70 above, bumper 80 has an end surface 89 that provides and an air and watertight seal at the end of the tube. The tube's horizontal section 54 along with the upper section 53 are affixed to the bumper 80 to provide a seal, with the holes 87, 88 below the horizontal section.

Figure 9A:
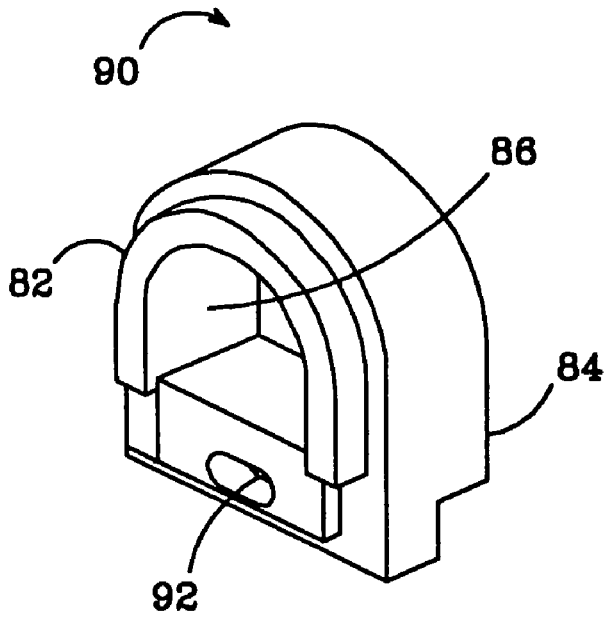
FIG. 9*a* is a perspective view of another embodiment of an end bumper according to the present invention.
Figure 9B:
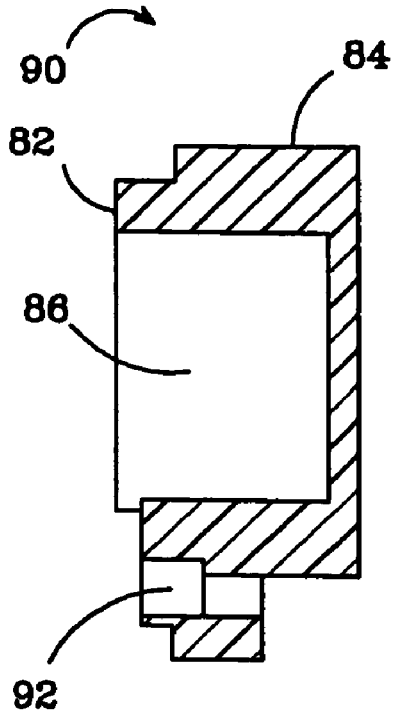
FIG. 9*b* is sectional view of the end bumper in FIG. 9*a*, taken along section lines 9*a*—9*a;*

FIGS. 9*a* and 9*b* show another embodiment of a bumper 90 according to the present invention that is the same in most respects to bumper 80. It has a curved section 82, and a cushion section 84 with a void 86, with the void allowing the cushion section 84 to more easily compress. It is mounted to the end of a tube 12 in the same way as bumper 80 to provide a protective seal at the end of the tube. However, instead of having holes for conductors to pass, the bumper 90 has a single channel 92 through which both conductors pass.

FIGS. 10*a*, 10*b*, 11 and 12 show junction covers that are designed to fit over junctions between adjacent daisy-chained lights 10 with the different covers designed to fit over different angles between the lights. The junction covers are preferably made of the same material as the tubes 12 that they are covering so that the cover emits the same color of light as the tubes 12. Each of the junction covers should transmit and disperse the light from the adjacent perimeter lights 10 and the bumpers 18 between the lights. By dispersing the light covers allow adjacent lights to appear as though there is no junction, so that multiple perimeter lights appear as though they are continuous.

Figure 10A:
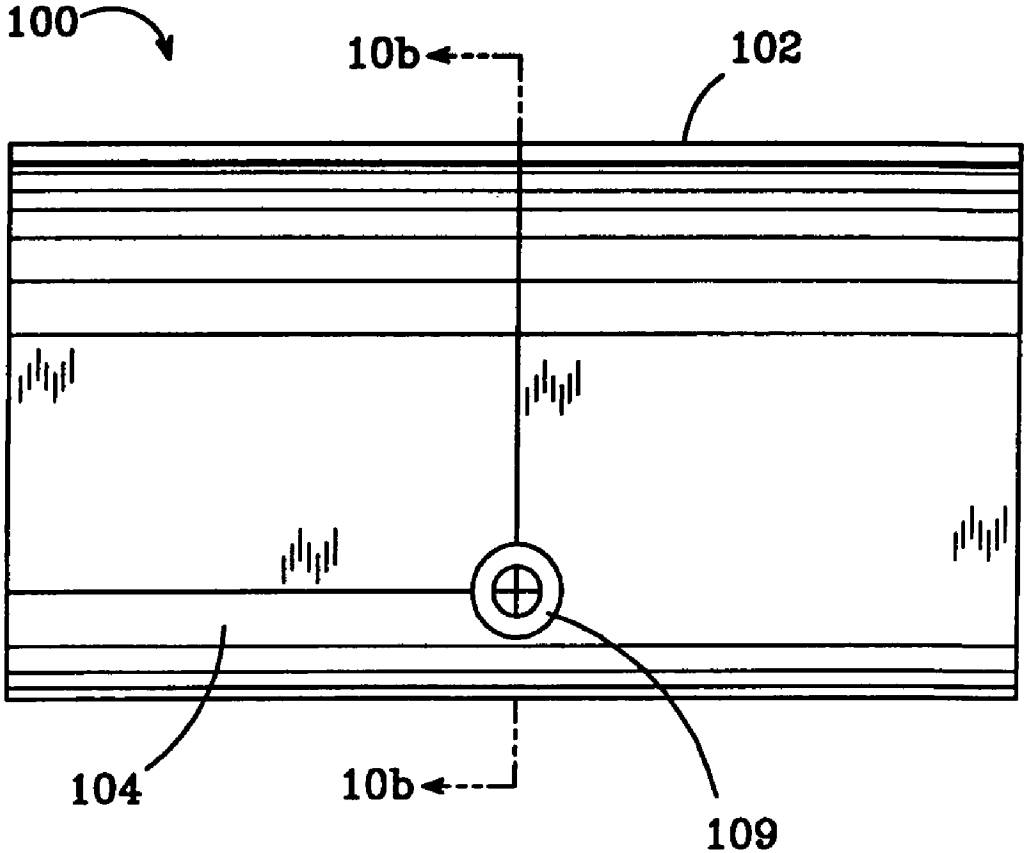
FIG. 10*a* as an elevation view of one embodiment of a bumper cover according to the present invention.
Figure 10B:
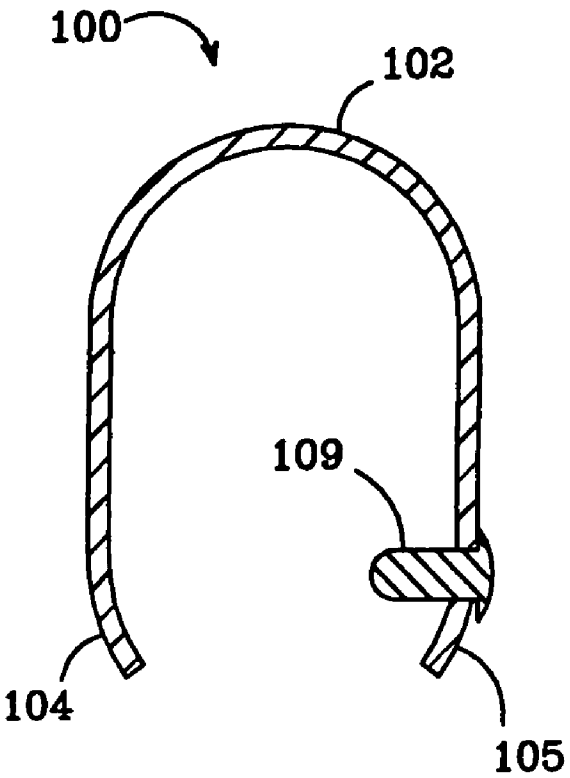
FIG. 10*b* is a sectional view of the bumper cover of FIG. 10*a*, according to the present invention.

FIGS. 10*a* and 10*b* show a junction cover 100 for covering the junction between two lights 10 that are linearly aligned. The inside surface of its cover's curved top section 102 has the same radius of curvature as the outside surface tube's top section 53 (shown in FIG. 5). The cover's lower portions 104, 105 taper to fit over the tapered section of the tube/lens's opposing tabs 55 and 56 (also shown in FIG. 5). The cover 100 can be press fit over the junction by placing it on the adjacent perimeter lights and applying a force to the cover 100, toward the perimeter lights. This causes the cover's lower portions 104, 105 to flex out, allowing the cover to slide down until its curved section 102 rests against the tube's curved top 53 and the tapered lower portions 104, 105 rest against the outside of the tube's opposing tabs 55, 56. Alternatively, the tubes can be slid into the junction cover 100.

With the expansion and contraction of adjacent lights 10, the cover 100 can move over the joint, which can result in the cover "walking off" the joint through repeated expansions and contractions. It is impractical to glue the cover over the joint because the lights would be prevented from moving under the joint through expansion and contraction. The cover lo includes one or more holding rivets 109 to help hold the cover over the joint. Each rivet passes through a hole in one of the cover's lower portions 104, 105 and extends into the joint between adjacent lights, under the end bumpers. As the lights expand and contract and the cover begins to walk off the joint, the rivet butts against the end of one of the tubes 12.

Figure 11:
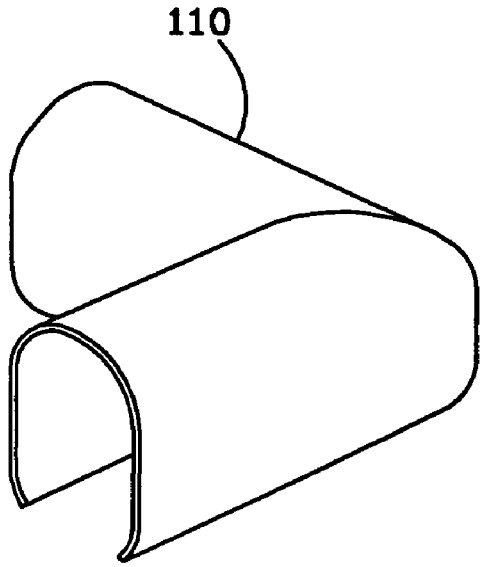
FIG. 11 is a perspective view of one embodiment of a corner cover according to the present invention.
Figure 12:
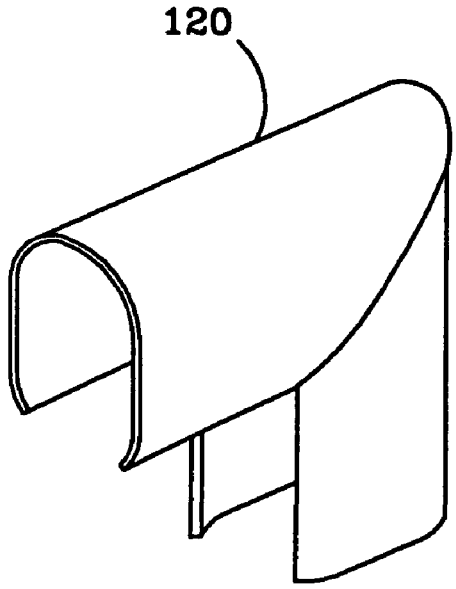
FIG. 12 is a perspective view of another embodiment of a corner cover according to the present invention.
Figure 13:
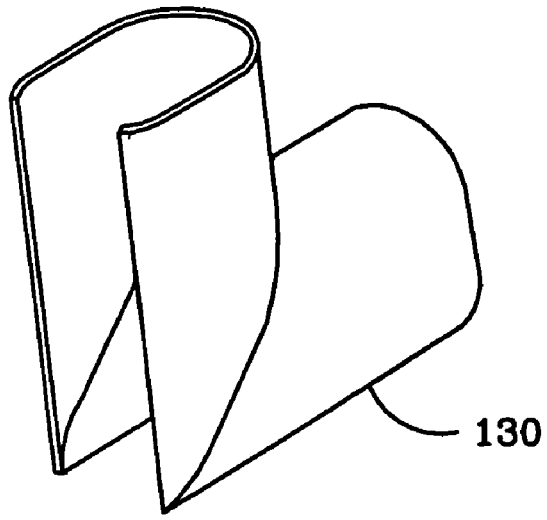
FIG. 13 is a perspective view of a third embodiment of a corner cover according to the present invention.

The perimeter lights 10 can also be used at corners of a structural feature, with the end of adjacent lights 10 meeting at the angle. FIG. 11 shows a junction cover 110 for fitting over the junction between two lights 10 that meet at a 90-degree angle with the adjacent lights 10 being in the same plane. FIG. 12 shows a junction cover 120 that is also for fitting over adjacent lights that meet at a 90-degree angle with the inside surface of the angle being against a structural feature, for perimeter lighting around a corner. FIG. 13 shows a junction cover 130 also for fitting over the junction between a lights meeting at a 90 degree angle with the emitting surface of the lights being on the inside of the angle. The junction covers can be press fit over the junction just as junction cover 100. Although the covers 110, 120 and 130 are for 90-degree angles, junction covers can be provided for lights 10 meeting at many different angles.

Figure 14:
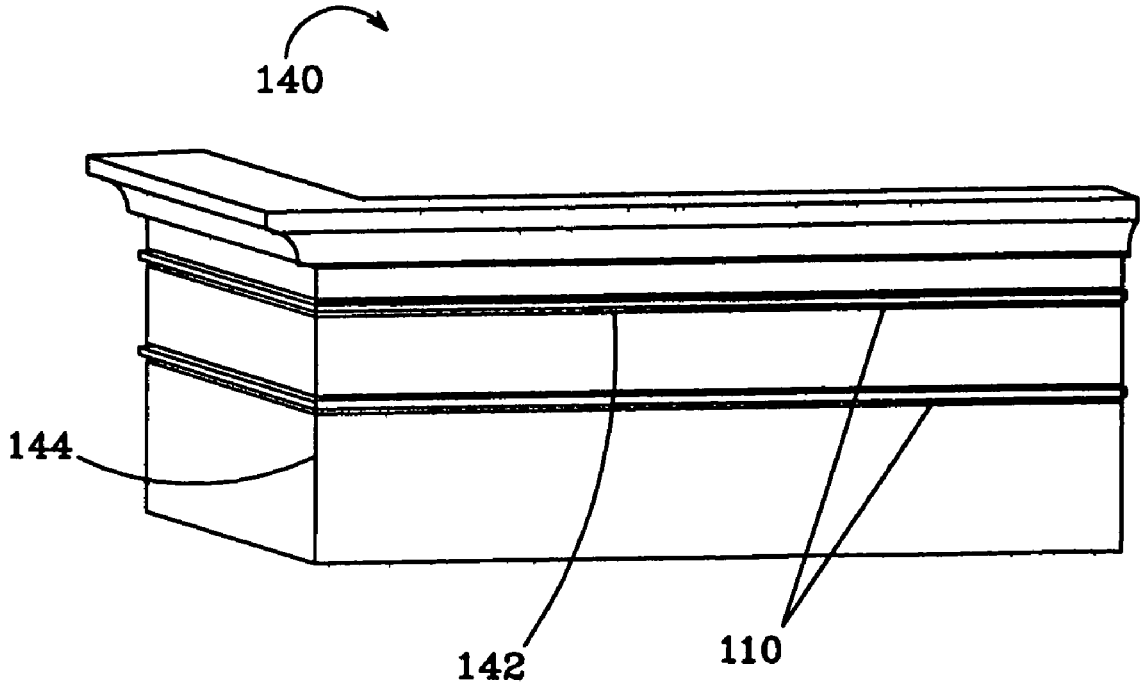
FIG. 14 is a perspective view of building's structural feature with one embodiment of the perimeter lighting according to the present invention.

FIG. 14 shows one embodiment of the perimeter lights 10 as they are mounted to a structural feature 140. Before mounting the lights, the mounting buttons must be affixed to the structural feature 140 at intervals along a line where the perimeter light is to be attached. The perimeter lights 10 can then be slid or snapped over the buttons to fix the lights in place. The lights 10 can also be cut to meet the length of the structural feature 140 as described above. After cutting, one of the end bumpers (not shown) should be mounted to the open end of the tube to protect the LED array and to provide cushioning between adjacent lights. More than one light 10 can be daisy chained to light a longer structural feature 142 with the joint between the lights covered by a joint cover (not shown). The perimeter lights 10 can also be mounted around a 90-degree corner 144 of the structural feature 140, with the corner joint between the lights covered by joint cover 120. The covers give the appearance of a continuous perimeter light along the feature 140.

Although the present invention has been described in considerable detail with reference to certain preferred configurations thereof, other versions are possible. Therefore, the spirit and scope of the invention should not be limited to their preferred versions described above.

We claim:

1. An elongated perimeter light, comprising:

an array of light sources that are illuminated by electric power;

an elongated translucent tube, said array of light sources disposed within said tube, said tube transmitting and dispersing the light from said array giving the appearance that said array of light sources is a continuous light source; and said array of light sources being cuttable at intervals to shorten said array while allowing the remaining light sources in said array to emit light, said tube being cuttable to match the length of said array, further comprising a mechanism for mounting said translucent tube to a structure, wherein said mounting mechanism comprises an anchoring slot integral with said tube and a plurality of mounting buttons, said mounting buttons mounted to the structure and cooperating with said slot to hold said tube on the structure.

2. The perimeter light of claim 1, wherein said array of light sources comprises a linear array of light sources.

3. The perimeter light of claim 1, wherein said array of light sources comprises an array of light emitting diodes.

4. The perimeter light of claim 1, further comprising a printed circuit board wherein said array of light sources is arranged on said printed circuit board in a plurality of parallel connected sub-arrays of light sources, said electric power coupled across each of said plurality of sub-arrays.

5. The perimeter light of claim 4, wherein printed circuit board is cuttable between two of said plurality of parallel connected sub-arrays.

6. The perimeter light of claim 1, further comprising a means for conducting said electrical power from said perimeter light to another device, wherein the cutting of said array of light sources does not interrupt the conduction of said electrical power.

7. The perimeter light of claim 1, further comprising bumpers mounted at the ends of said tube to protect said array of light sources.

* * * * *

UNITED STATES PATENT AND TRADEMARK OFFICE

CERTIFICATE OF CORRECTION

PATENT NO. : 6,969,179 B2
DATED : November 29, 2005
INVENTOR(S) : Thomas C. Sloan and James J. Sloan It is certified that error appears in the above-identified patent and that said Letters Patent is hereby corrected as shown below:

Title page,
Item [57], ABSTRACT, should read

An elongated perimeter light includes an array of light sources that are disposed within an elongated transparent tube. The tube transmits and disperses light from the array, giving the appearance that the array of light sources is continuous. The array of light sources is capable of being cut at intervals down its length to shorten it. The tube can then be cut to match the length of the array. The light sources that remain in the array continue to emit light.

Column 3,
Line 65, change "LEDS" to read -- LEDs --.

Column 8,
Line 47, delete "lo" and insert -- 100 --.

Signed and Sealed this

Fourth Day of April, 2006

JON W. DUDAS
*Director of the United States Patent and Trademark Office*